US009643429B2

(12) United States Patent
Matsumoto et al.

(10) Patent No.: US 9,643,429 B2
(45) Date of Patent: May 9, 2017

(54) PROCESSING OBJECT MODIFYING APPARATUS, PRINTING APPARATUS, PRINTING SYSTEM, AND METHOD FOR MANUFACTURING PRINTOUT

(71) Applicants: Hiroyoshi Matsumoto, Kanagawa (JP); Junji Nakai, Kanagawa (JP)

(72) Inventors: Hiroyoshi Matsumoto, Kanagawa (JP); Junji Nakai, Kanagawa (JP)

(73) Assignee: Ricoh Compant, Ltd., Tokyo (JP)

( * ) Notice: Subject to any disclaimer, the term of this patent is extended or adjusted under 35 U.S.C. 154(b) by 0 days.

(21) Appl. No.: 14/958,790

(22) Filed: Dec. 3, 2015

(65) Prior Publication Data

US 2016/0214403 A1 Jul. 28, 2016

Related U.S. Application Data

(63) Continuation of application No. 14/656,529, filed on Mar. 12, 2015, now Pat. No. 9,227,430.

(30) Foreign Application Priority Data

Mar. 14, 2014 (JP) ..... 2014052762
Feb. 5, 2015 (JP) ..... 2015021630

(51) Int. Cl.
*B41J 11/00* (2006.01)
*H05H 1/00* (2006.01)
(Continued)

(52) U.S. Cl.
CPC ..... *B41J 11/002* (2013.01); *B41J 11/0015* (2013.01); *B41J 11/42* (2013.01);
(Continued)

(58) Field of Classification Search
CPC ..... B41J 11/00; B41J 11/0015; B41M 2/17; B41M 5/0011
See application file for complete search history.

(56) References Cited

U.S. PATENT DOCUMENTS

2004/0135828 A1 7/2004 Schmitt et al.
2006/0197802 A1 9/2006 Konno
(Continued)

FOREIGN PATENT DOCUMENTS

JP 2000290548 A 10/2000
JP 2003034069 A 2/2003
(Continued)

*Primary Examiner* — Julian Huffman
*Assistant Examiner* — Sharon A Polk
(74) *Attorney, Agent, or Firm* — Duft Bornsen & Fettig LLP

(57) ABSTRACT

A processing object modifying apparatus includes a conveying unit that conveys a processing object; a plasma processing unit that performs plasma processing onto a surface of the processing object while the processing object is being conveyed by the conveying unit; a measuring unit that measures a pH value of the processing object to which the plasma processing has been applied; and a controlling unit that controls the conveying unit to change a conveying speed of the processing object on the basis of a measurement result of the measuring unit, the processing object to which the plasma processing is being applied.

12 Claims, 13 Drawing Sheets

(51) Int. Cl.
*B41J 11/42* (2006.01)
*H05H 1/24* (2006.01)

(52) U.S. Cl.
CPC ..... *H05H 1/0006* (2013.01); *H05H 1/2406* (2013.01); *H05H 2001/2418* (2013.01)

(56) References Cited

U.S. PATENT DOCUMENTS

| | | | | |
|---|---|---|---|---|
| 2007/0058019 | A1 | 3/2007 | Saitoh et al. | |
| 2009/0290007 | A1 | 11/2009 | Saitoh et al. | |
| 2010/0316777 | A1 | 12/2010 | Joly et al. | |
| 2011/0064489 | A1 | 3/2011 | Bisaiji et al. | |
| 2013/0250017 | A1 | 9/2013 | Saitoh et al. | |
| 2014/0078212 | A1 | 3/2014 | Nakai et al. | |
| 2014/0160197 | A1* | 6/2014 | Hirose ..... | B41M 5/0011 347/16 |
| 2015/0035918 | A1 | 2/2015 | Matsumoto et al. | |

FOREIGN PATENT DOCUMENTS

| | | | |
|---|---|---|---|
| JP | 2004237520 | A | 8/2004 |
| JP | 2010188568 | A | 9/2010 |
| JP | 2013199017 | A | 10/2013 |

* cited by examiner

PROCESSING OBJECT MODIFYING APPARATUS, PRINTING APPARATUS, PRINTING SYSTEM, AND METHOD FOR MANUFACTURING PRINTOUT

CROSS-REFERENCE TO RELATED APPLICATIONS

This patent application is a continuation of co-pending U.S. patent application Ser. No. 14/656,529 (filed on Mar. 12, 2015) titled "PROCESSING OBJECT MODIFYING APPARATUS, PRINTING APPARATUS, PRINTING SYSTEM, AND METHOD FOR MANUFACTURING PRINTOUT," which is hereby incorporated by reference. The present application also claims priority to and incorporates by reference the entire contents of Japanese Patent Application No. 2014-052762 filed in Japan on Mar. 14, 2014 and Japanese Patent Application No. 2015-021630 filed in Japan on Feb. 5, 2015.

BACKGROUND OF THE INVENTION

1. Field of the Invention

The present invention relates to a processing object modifying apparatus, a printing apparatus, a printing system, and a method for manufacturing a printout.

2. Description of the Related Art

Improvement in the throughput of conventional inkjet recording apparatuses by using high-speed printing has been difficult, because most inkjet recording apparatuses are shuttle-based, in which a head is moved back and forth in the width direction of a recording medium, e.g., a paper sheet or a film. To allow such recording apparatuses to provide high-speed printing, one-pass printing, in which an arrangement of a plurality of heads covering the entire width of the recording medium is passed across the sheet to record at once, has been disclosed recently.

One-pass printing is effective in improving the printing speed. However, because time intervals at which ink droplets are ejected to form dots adjacent to each other are short, and each of the ink droplets is ejected to form an adjacent dot before the ink droplet ejected earlier permeates into the recording medium, coalescence of the adjacent dots (hereinafter, referred to as ink-droplet interference) is likely to occur, and may reduce image quality. Related art examples are disclosed in Japanese Patent No. 4662590, Japanese Patent Application Laid-open No. 2010-188568, and Japanese Patent Application Laid-open No. 2003-34069.

In view of the above situations, there is a need to provide a processing object modifying apparatus, a printing apparatus, printing system, and a method for manufacturing a printout, which can modify the processing object to manufacture a high-quality printout.

SUMMARY OF THE INVENTION

It is an object of the present invention to at least partially solve the problems in the conventional technology.

According to an embodiment, there is provided a processing object modifying apparatus including a conveying unit that conveys a processing object; a plasma processing unit that performs plasma processing onto a surface of the processing object while the processing object is being conveyed by the conveying unit; a measuring unit that measures a pH value of the processing object to which the plasma processing has been applied; and a controlling unit that controls the conveying unit to change a conveying speed of the processing object on the basis of a measurement result of the measuring unit, the processing object to which the plasma processing is being applied.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
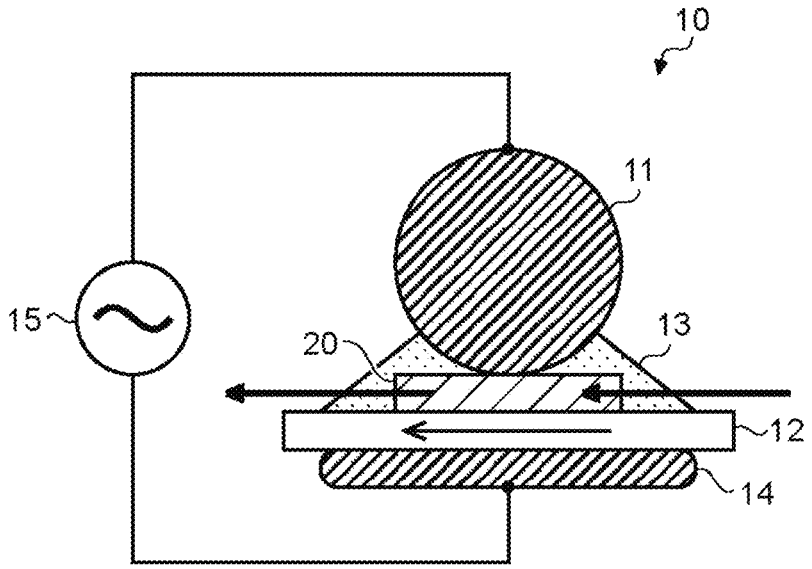
FIG. 1 is a schematic illustrating an example of a plasma processing apparatus that performs plasma processing used in a first embodiment.

Some preferred embodiments of the present invention will now be explained in detail with reference to the appended drawings. In the embodiments described hereunder, various limitations that are technically preferable are imposed because described hereunder are preferred embodiments of the present invention. The scope of the present invention, however, is not baselessly limited by the explanation hereunder, and not all of the configurations explained in the embodiments are mandatory requirements of the present invention.

First Embodiment

A processing object modifying apparatus, a printing apparatus, a printing system, and a method for manufacturing a printout according to a first embodiment will now be explained in detail with reference to some of the drawings. To enable a high-quality printout to be produced through modification of a surface of a processing object, the first embodiment has characteristics as described below.

In the first embodiment, a surface of a processing object (also referred to as a recording medium or a printing medium) is acidified to prevent dispersion of ink pigments, and to promote agglomeration of the ink pigments immediately after the ink lands on the processing object. Atmospheric plasma processing using a dielectric-barrier, surface creeping streamer discharge is used as an example of the means for acidifying the surface of the processing object, but the embodiment is not necessarily limited thereto.

In the embodiment described below, by controlling the plasma energy amount in such a manner that the acidity (pH) of the surface of the processing object is brought to a target range, the circularity of ink dots (hereinafter, simply referred to as dots) are improved, the dot coalescence is prevented, and the dot sharpness and the dot color gamut are improved and broadened. In this manner, image defects such as beading and breading can be reduced, and printouts with high-quality images can be produced. Furthermore, reducing the thickness of the agglomeration of pigments on the printing medium and making the agglomeration more even can reduce the amount of ink droplet, the energy for drying the ink, and thus printing costs.

Before explaining the first embodiment, an example of the plasma processing used in the first embodiment will now be explained in detail with reference to some of the drawings. In the plasma processing used in the first embodiment, the processing object is irradiated with atmospheric plasma, thereby causing reactions of the polymer and producing a hydrophilic functional group on the surface of the processing object. More specifically, the electrons e emitted from the discharge electrode are accelerated in an electric field, and excite and ionize atmospheric atoms and molecules. The ionized atoms and molecules also emit electrons, so that the number of high-energy electrons is increased. As a result, streamer discharge (plasma) occurs. These high-energy electrons resulting from the streamer discharge unbind the polymer on the surface of the processing object 20 (e.g., coat paper) (the starch serving as a binder and hardening the coat layer 21 of coat paper with calcium carbonate has a polymer structure), and re-bind with oxygen radicals O*, the hydroxyl radicals (*OH), and ozone $O_3$ in the gas phase. This entire process is called plasma processing. With this processing, a polarity functional group such as hydroxyl or carboxyl group is produced on the surface of the processing object 20. As a result, hydrophilic property and acidity are given to the surface of the processing object 20. An increase in the carboxyl group promotes acidification of the surface of the processing object (drops the pH).

Having hydrophilic property improved, the ink on adjacent dots spreads across the surface of the processing object and coalesces together. In order to prevent mixing of colors between the dots resulting from coalescence, it is necessary to cause the colorant (for example, pigments or dye) in the dots to agglomerate quickly, to dry the vehicle, or to allow the vehicle to permeate into the processing object before the vehicle spreads. Because the plasma processing explained as an example above also serves as acidifying means (process) for acidifying the surface of the processing object, the agglomeration speed of colorant in the dots can be increased. From this regard as well, the plasma processing is effective as a pre-process of the inkjet recording process.

In the first embodiment, an atmospheric-pressure non-equilibrium plasma processing using dielectric barrier discharge may be used as the plasma processing, for example. Acidification processing with the atmospheric-pressure non-equilibrium plasma is a preferable alternative for the plasma processing of the processing object such as a recording medium, because the electron temperature is extremely high, and the gas temperature is near the ordinary temperature.

An exemplary method for stably generating atmospheric-pressure non-equilibrium plasma in a wide area is atmospheric-pressure non-equilibrium plasma processing using dielectric barrier discharge that is based on streamer breakdown. Dielectric barrier discharge based on the streamer breakdown can be achieved by, for example, applying a high alternating voltage between electrodes covered by a dielectric. Various methods other than the dielectric barrier discharge based on streamer breakdown may also be used as methods for generating the atmospheric-pressure non-equilibrium plasma. Examples of such methods include dielectric barrier discharge in which an insulator, such as a dielectric, is inserted between electrodes, corona discharge in which an extreme non-uniform electric field is formed around a thin metal wire or the like, pulse discharge in which a short-pulse voltage is applied, and a combination of two or more of the above.

FIG. 1 is a schematic illustrating an example of a plasma processing apparatus that performs the plasma processing used in the first embodiment. For the plasma processing used in the first embodiment, a plasma processing apparatus 10 including a discharge electrode 11, a counter electrode (also referred to as a ground electrode) 14, a dielectric 12, and a high-frequency high-voltage power source 15, as illustrated in FIG. 1, may be used. The dielectric 12 interposed between the discharge electrode 11 and the counter electrode 14 may be an insulator such as polyimide, silicone, or ceramic. The discharge electrode 11 and the counter electrode 14 may be electrodes having their metal part exposed, or may be electrodes covered by a dielectric or an insulator such as insulating rubber or ceramic. When corona discharge is used in the plasma processing, the dielectric 12 may be omitted. By contrast, there are also cases in which it is preferable for the dielectric 12 to be provided, e.g., when the dielectric barrier discharge is used. In such a configuration, the effect of the plasma processing can be enhanced by positioning the dielectric 12 near or in contact with the counter electrode 14, rather than near or in contact with the discharge electrode 11, so that the area of creeping discharge is increased. The discharge electrode 11 and the counter electrode 14 (or an electrode on the side provided with the dielectric 12 or the dielectric 12) may be positioned in contact with or not in contact with a printing medium passed between the two electrodes.

The high-frequency high-voltage power source 15 applies a high-frequency high-voltage pulse voltage between the discharge electrode 11 and the counter electrode 14. The pulse voltage is 10 kilovolts (p-p) or so, for example. The frequency of the pulse voltage may be, for example, approximately 20 kilohertz. By supplying such a high-frequency high-voltage pulse voltage between the two electrodes, atmospheric-pressure non-equilibrium plasma 13 is generated between the discharge electrode 11 and the dielectric 12. The processing object 20 is passed between the discharge electrode 11 and the dielectric 12 while the atmospheric-pressure non-equilibrium plasma 13 is being generated. As a result, a surface of the processing object 20 nearer to the discharge electrode 11 is plasma-processed.

Used in the plasma processing apparatus 10 illustrated in FIG. 1 are a rotating discharge electrode 11 and a belt-conveyer type dielectric 12. The processing object 20, being nipped between and carried by the rotating discharge electrode 11 and the dielectric 12, passes through the atmospheric-pressure non-equilibrium plasma 13. In this manner, the surface of the processing object 20 is brought into contact with the atmospheric-pressure non-equilibrium plasma 13, and uniformly applied with the plasma processing. However, the plasma processing apparatus used in the first embodiment is not limited to the structure illustrated in FIG. 2. Various modifications are possible, including a structure in which the discharge electrode 11 is spaced close to but not brought into contact with the processing object 20, or a structure in which the discharge electrode 11 is mounted on the carriage on which the inkjet head is also mounted.

Figure 2:
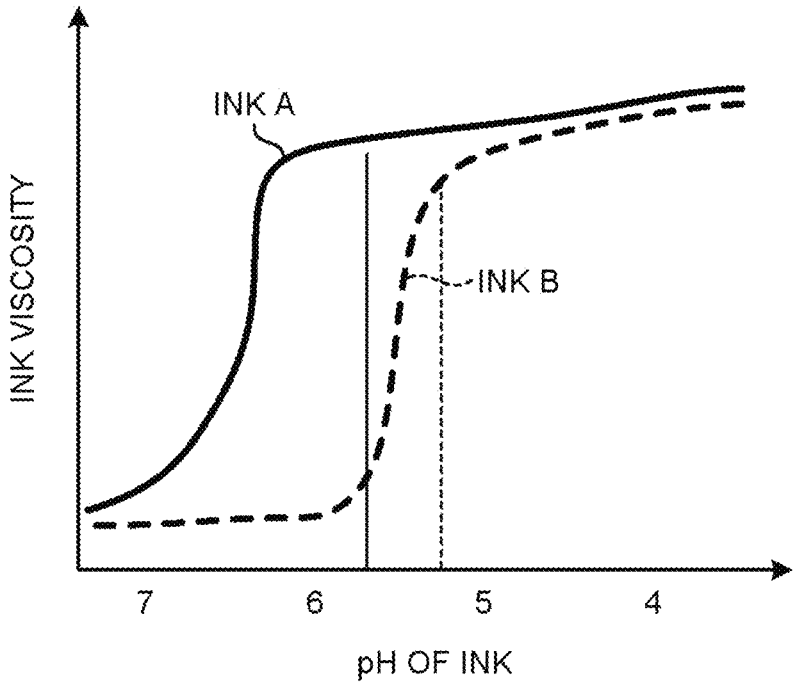
FIG. 2 is a schematic illustrating an example of a relation between the pH of ink and the ink viscosity in the first embodiment.

Acidification herein means bringing down the pH of the surface of a printing medium to a level in which pigments in ink agglomerate. Bringing down the pH means raising the hydrogen ion $H^+$ concentration of the object. Pigments in the ink before being brought into contact with the surface of the processing object are negatively charged, and the pigments are dispersed across the vehicle. FIG. 2 illustrates an example of a relation between the pH of ink and the ink viscosity. As illustrated in FIG. 2, ink is more viscous when the pH of the ink is lower. When the ink is more acidified, the negatively charged pigments in the vehicle of the ink become more electrically neutralized, and, as a result, the pigments agglomerate. For example, in the graph illustrated in FIG. 2, ink viscosity can be increased by reducing the pH of the surface of the printing medium to an ink pH that corresponds to the required viscosity. Such viscosity is achieved because, when the ink is attached to the acid surface of the printing medium, the pigments become electrically neutralized by the hydrogen ions $H^+$ on the surface of the printing medium, and agglomerate. In this manner, mixing of colors in adjacent dots can be prevented, and the pigments can be prevented from permeating deeper into the printing medium (and further into the rear side). To reduce the pH of the ink to a level corresponding to a required viscosity, however, it is necessary to reduce the pH of the surface of the printing medium to a lower than that corresponding to the required viscosity.

The pH for achieving the required ink viscosity differs depending on the ink characteristics. Specifically, there are some types of ink containing pigments that agglomerate and become more viscous at a pH that is relatively near neutral, as illustrated with ink A in FIG. 2, and there are other types of ink that require a lower pH for the pigments to agglomerate, compared with the ink A, as illustrated as ink B having different characteristics from the ink A.

The behavior of colorant agglomerating in a dot, the drying speed of the vehicle, and its permeation speed into the processing object differ depending on the size of an ink droplet that is dependent on the dot size (a small droplet, a medium droplet, or a large droplet), and the type of the processing object, for example. To address this issue, in the first embodiment, the plasma energy amount in the plasma processing may be controlled to an optimum level depending on the type of the processing object and the printing mode (droplet size). Large droplets may be used to allow the image to be filled quickly, by increasing the size of one dot. A large droplet may be formed by ejecting a plurality of small droplets from the same nozzle, and allowing the small droplets to coalesce in the air.

Figure 3:
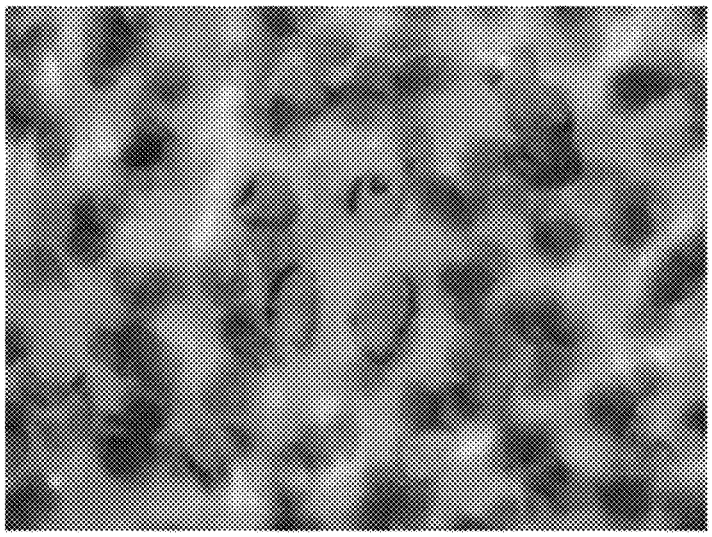
FIG. 3 is an enlargement of a photograph of an image formation surface achieved by performing an inkjet recording process to a processing object not applied with the plasma processing according to the first embodiment.
Figure 4:
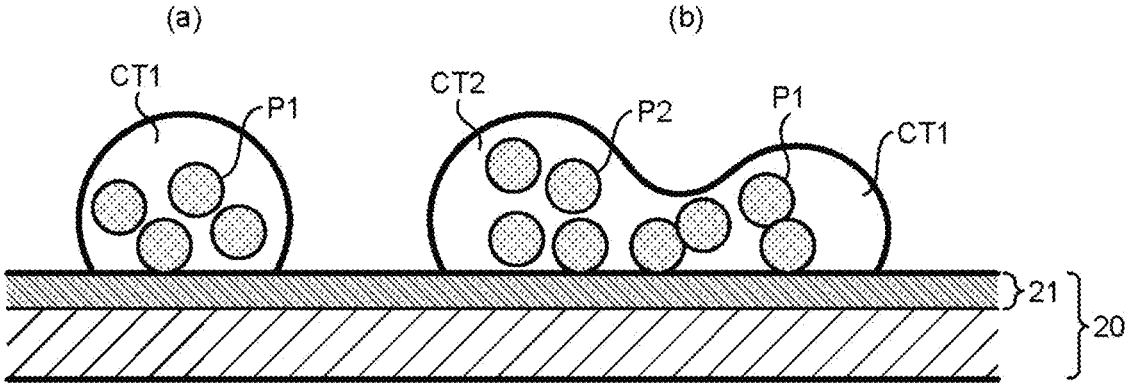
FIG. 4 is a schematic of exemplary dots formed on an image formation surface of the printout illustrated in FIG. 3.
Figure 5:
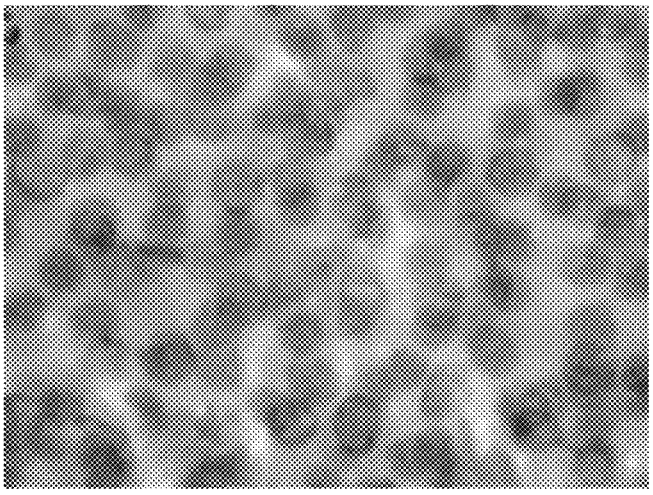
FIG. 5 is an enlargement of a photograph of an image formation surface achieved by performing the inkjet recording process to a processing object applied with the plasma processing according to the first embodiment.
Figure 6:
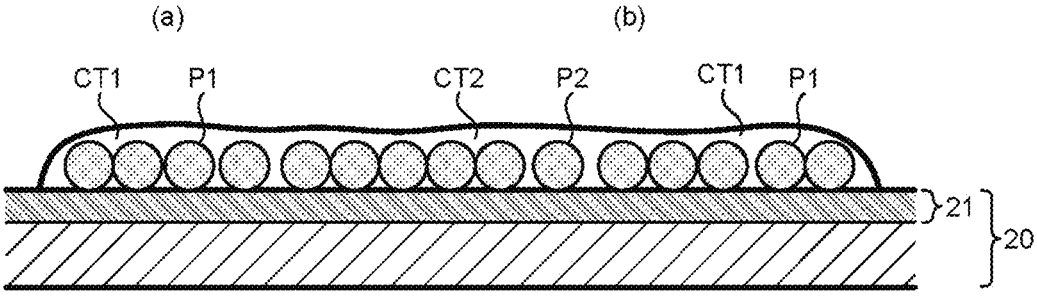
FIG. 6 is a schematic of exemplary dots formed on the image formation surface in the printout illustrated in FIG. 5.

Differences in printouts applied with and not applied with the plasma processing according to the first embodiment will now be explained with reference to FIGS. 3 to 6. FIG. 3 is an enlargement of a photograph of an image formation surface achieved by performing the inkjet recording process to a processing object not applied with the plasma processing according to the first embodiment. FIG. 4 is a schematic of exemplary dots formed on an image formation surface of the printout illustrated in FIG. 3. FIG. 5 is an enlargement of a photograph of an image formation surface achieved by performing the inkjet recording process to a processing object applied with the plasma processing according to the first embodiment. FIG. 6 is a schematic of exemplary dots formed on the image formation surface in the printout illustrated in FIG. 5. To achieve the printout illustrated in FIGS. 3 and 5, a desk-top inkjet recording apparatus is used. As the processing object 20, general coat paper having a coat layer 21 is used.

On the coat paper not applied with the plasma processing, the coat layer 21 on the coat paper surface has bad wettability. Therefore, in the image formed by performing the inkjet recording process to the coat paper not having applied with the plasma processing, the shape of the dots (vehicle CT1) attached on the surface of the coat paper become misshaped when the ink lands on the coat paper, for example, as illustrated in FIGS. 3 to 4. If a dot is formed adjacent to other dot that is not sufficiently dried, the vehicle CT1 and the vehicle CT2 coalesce together, as illustrated in FIGS. 3 to 4, when the ink for the adjacent dot lands on the coat paper. This coalescence causes pigments P1 and P2 to move between the dots (mixing of colors), and the resultant image may have density unevenness resulting from beading, for example.

By contrast, the coat layer 21 on the coat paper surface of the coat paper applied with the plasma processing according to the first embodiment has better wettability. In the image formed by applying the inkjet recording process to the coat paper applied with the plasma processing, the vehicle CT1 spreads in a relatively flat true circle on the surface of the coat paper, as illustrated in FIG. 5, for example. This results in a flat dot, as illustrated in FIG. 6. Furthermore, because the polarity functional group produced by the plasma processing makes the coat paper surface acid, the ink pigments become electrically neutralized, causing the pigments P1 to agglomerate, and the ink viscosity to be increased. Increased viscosity prohibits the movement of the pigments P1 and P2 between the dots (mixing of colors), even when the vehicle CT1 and the vehicle CT2 coalesce together, as illustrated in FIG. 6. Furthermore, because the polarity functional group is produced inside of the coat layer 21, the permeability of the vehicle CT1 is increased. Having permeability improved, the ink dries in a relatively short time. Because dots having wettability improved spreading in a true circle agglomerate while permeating, the pigments P1 agglomerate evenly in the height direction, and density unevenness resulting from beading or the like can be suppressed. FIGS. 4 and 6 are schematic representations, and in reality, the pigments agglomerate in a layered manner, also in the example illustrated in FIG. 6.

In the processing object 20 applied with the plasma processing according to the first embodiment, the hydrophilic functional group is produced on the surface of the processing object 20 in the plasma processing, and so the processing object 20 has better wettability. Furthermore, the plasma processing makes the surface of the processing object 20 coarser, and as a result, the wettability of the surface of the processing object 20 is improved again. Moreover, because the plasma processing produces the polarity functional group, the surface of the processing object 20 is acidified. This acidification allows the ink landed on the surface of the processing object 20 to spread evenly and the negatively charged pigments to become neutralized and agglomerate on the surface of the processing object 20, thereby making the ink more viscous. As a result, movements of the pigments can be prohibited even if the dots coalesce together. Furthermore, because the polarity functional group produced on the surface of the processing object 20 is also produced in the coat layer 21, the vehicle quickly permeates into the processing object 20. This quick permeation allows a drying time to be reduced. Specifically, because the dots with better wettability spread in a true circle, and permeate into the processing object while the movements of pigments are prohibited by the agglomeration, the shape near the true circle can be maintained.

Figure 7:
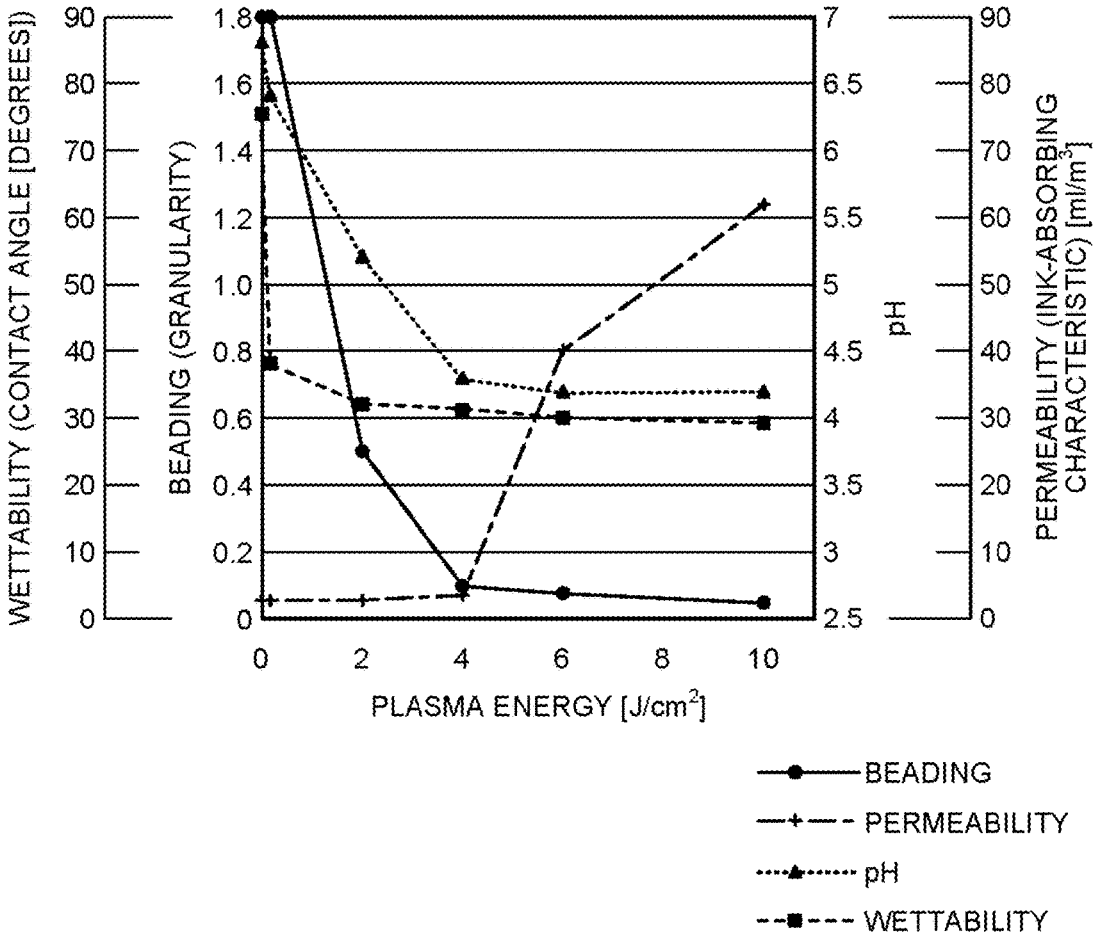
FIG. 7 is a graph illustrating a relation between the plasma energy, the wettability, the beading, the pH, and the permeability of a surface of the processing object in the first embodiment.

FIG. 7 is a graph illustrating a relation between the plasma energy, and the wettability, the beading, the pH, and the permeability of the processing object surface in the first embodiment. FIG. 7 illustrates how the surface characteristics (wettability, beading, pH, permeability (ink-absorbing characteristic)) of coat paper on which printing is performed as a processing object 20 change depending on the plasma energy. To conduct the evaluation resulting in the graph illustrated in FIG. 7, water-based pigment ink (alkaline ink in which negatively charged pigments are dispersed) containing pigments that agglomerate with acid is used.

As illustrated in FIG. 7, the wettability of a coat paper surface has sharply improved at low plasma energy (e.g., equal to or smaller than 0.2 J/cm$^2$ or so), and does not improve very much even if the energy increases any further. By contrast, the pH of the coat paper surface decreases, to some extent, as the plasma energy increases, but saturates at a point where the plasma energy exceeds a certain level (e.g., 4 J/cm$^2$ or so). The permeability (ink-absorbing characteristic) has sharply improved around the area near where the pH decrease saturated (e.g., 4 J/cm$^2$ or so). This phenomenon, however, differs depending on the polymer component of the ink.

As described above, in the relation between the surface characteristics of the processing object 20 and the image quality, the dot circularity has improved when the wettability of the surface has improved. It is quite likely that this phenomenon occurs because the wettability of the surface of the processing object 20 has been improved and is uniformized due to the increased coarseness of the surface introduced by the plasma processing and the hydrophilic polarity functional group generated by the plasma processing. It is also quite likely that the plasma processing removes water-repelling factors such as dusts, oil, and calcium carbonate from the surface of the processing object 20. Specifically, it is quite probable that ink droplets are allowed to spread evenly toward the circumferential direction, and the dot circularity has been improved, due to the improved wettability of the surface of the processing object 20 and destabilizing factors removed from the surface of the processing object 20.

By acidifying (decreasing the pH of) the surface of the processing object 20, agglomeration of ink pigments, improvement in permeability, and permeation of the vehicle into the coat layer are promoted. As a result, the pigment density on the surface of the processing object 20 is increased. An increased pigment density can prohibit movements and mixing of the pigments even when the dots coalesce, and the pigments are allowed to settle and agglomerate evenly on the surface of the processing object 20. The effect of prohibiting the mixture of pigments, however, varies depending on the constituent of the ink and the size of an ink droplet. For example, mixing of pigments due to dot coalescence occurs less frequently when the ink droplet is smaller in size compared with when it is larger in size (at least three times larger than the size of a small droplet). This is because the vehicle in a smaller droplet dries and permeates faster, and a small pH reaction can cause the pigments to agglomerate. The effect of the plasma processing varies depending on the types of the processing object 20 and the environment (e.g., humidity) surrounding it. Therefore, the plasma energy amount used in the plasma processing may be controlled to an optimum level depending on the ink droplet size, the type of the processing object 20 and the environment surrounding the processing object 20. As a result, in some cases, the surface modification efficiency of the processing object 20 is improved, and further energy saving is achieved.

Figure 8:
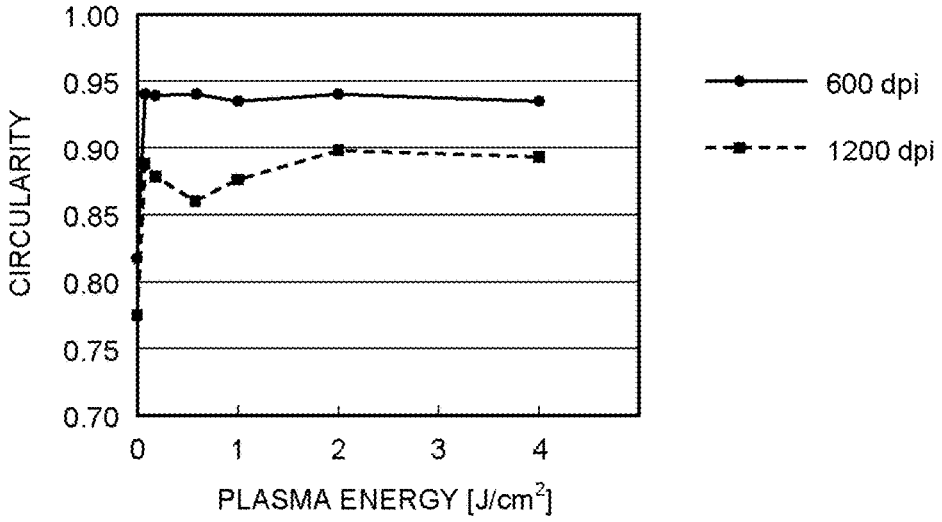
FIG. 8 is a graph illustrating a relation between the plasma energy and the dot circularity according to the first embodiment.
Figure 9:
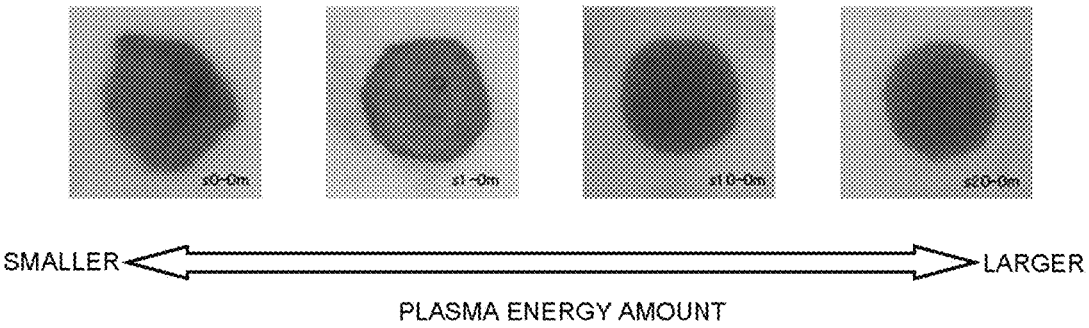
FIG. 9 is a schematic of a relation between the plasma energy amount and the shape of actually formed dots in the first embodiment.

A relation between the plasma energy amount and the dot circularity will now be explained. FIG. 8 is a graph illustrating a relation between the plasma energy and the dot circularity. FIG. 9 is a schematic of a relation between the plasma energy amount and the shape of actually formed dots. Illustrated in FIGS. 8 and 9 are examples in which the ink of the same type and the same color is used.

As illustrated in FIGS. 8 and 9, the dot circularity has dramatically been improved even with small plasma energy amount (e.g., equal to or smaller than 0.2 J/cm$^2$ or so). It is quite likely that, this is because the plasma processing of the processing object 20 has increased the dot (vehicle) viscosity and the permeability of the vehicle, the pigments have agglomerated evenly, as mentioned earlier.

Figure 10:
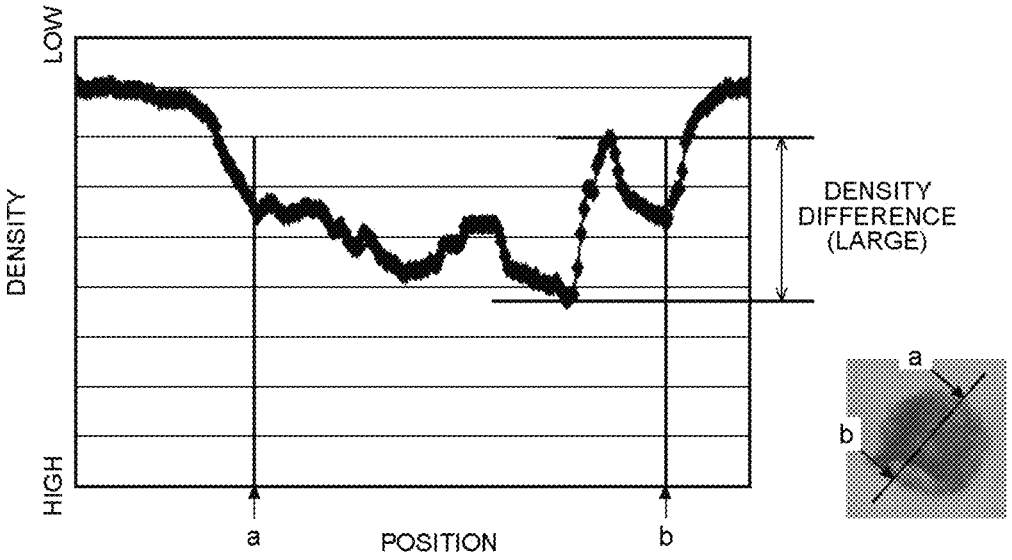
FIG. 10 is a graph illustrating a dot pigment density achieved without the plasma processing according to the first embodiment.
Figure 11:
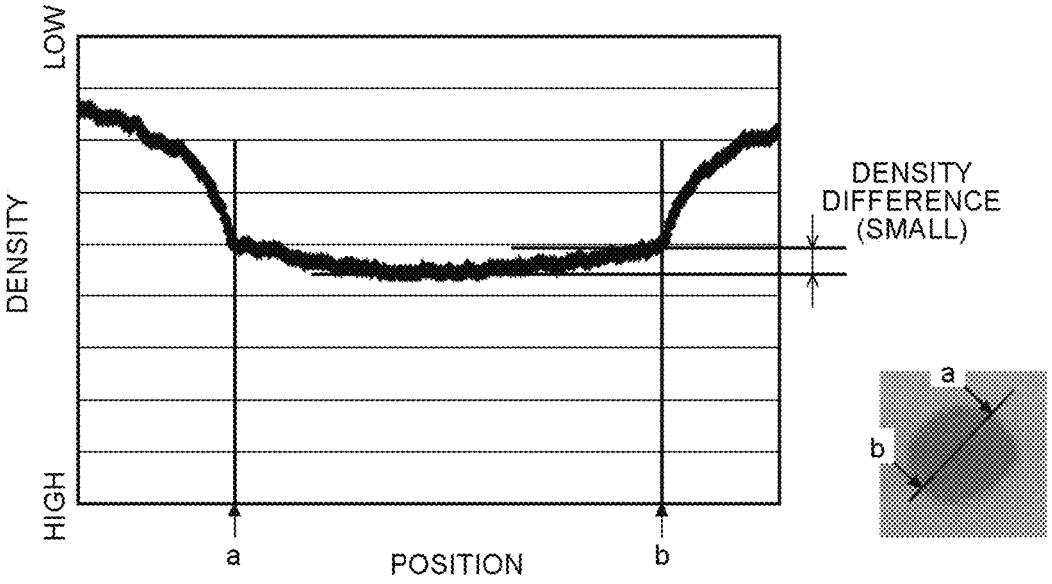
FIG. 11 is a graph illustrating the dot pigment density achieved with the plasma processing according to the first embodiment.

The dot pigment densities when the plasma processing is performed and when the plasma processing is not performed will now be explained. FIG. 10 is a graph illustrating a dot pigment density achieved without the plasma processing according to the first embodiment. FIG. 11 is a graph illustrating the dot pigment density achieved with the plasma processing. Each of FIGS. 10 and 11 illustrates the density along the line segment a-b in the dot image illustrated at the lower right in the corresponding drawing.

In the measurement in FIGS. 10 and 11, images of the formed dots are collected, and the density unevenness in the image is measured. The variation in the densities is then calculated. As it may be clear from the comparison of FIGS. 10 and 11, the density variation (differences in the density) is smaller with the plasma processing (FIG. 11), than that without the plasma processing (FIG. 10). Taking this result into consideration, the plasma energy amount used in the plasma processing may be optimized so as to minimize the variation (difference in the density), based on the density variation calculated in the manner described above. In this manner, sharper images can be formed.

The density variation may also be calculated by measuring the thickness of the pigments using an optical interference film thickness measurement technique, without limitation to the calculation described above. In such a case, an optimum plasma energy amount for minimizing the thickness of the pigments can be selected.

Illustrated in FIGS. 8 to 11 are exemplary results of measurements of dots in a first color formed on the surface of the processing object. The same measurement method used for the dots in the first color may also be used to achieve the results illustrated in FIGS. 8 to 11 for a second color.

Figure 12:
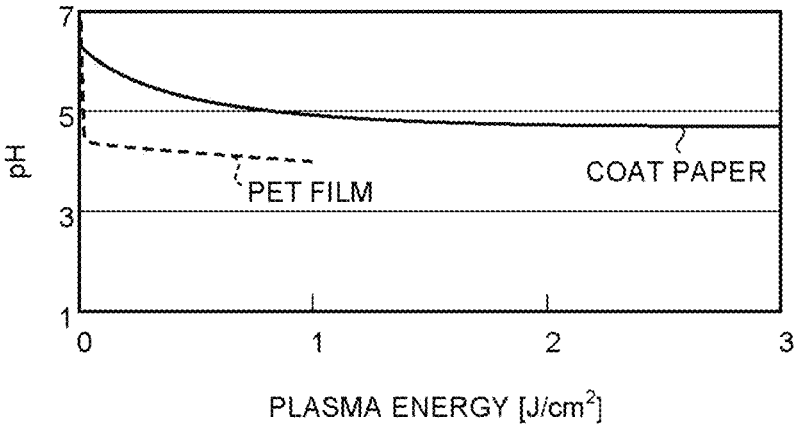
FIG. 12 is a graph illustrating a relation between the plasma energy and the pH according to the first embodiment.

FIG. 12 is a graph illustrating a relation between the plasma energy and the pH according to the first embodiment. Although the pH is generally measured in a solution, recent technologies have also allowed a pH to be measured on a solid surface. Examples of the measurement instrument include pH Meter B-211 and pH Tester Pen manufactured by Horiba, Ltd.

In FIG. 12, the solid line represents the dependency of the pH of coat paper on the plasma energy, and the dotted line presents the dependency of the pH of polyethylene terephthalate (PET) film on the plasma energy. As illustrated in FIG. 12, the PET film is acidified with a smaller plasma energy compared with the coat paper. The plasma energy amount, however, required to acidify the coat paper is also at a level equal to or smaller than 3 $J/cm^2$ or so. When an image is recorded on the processing object 20 having a pH reduced to a level equal to or lower than 5, using an inkjet recording apparatus ejecting alkaline water-based pigments ink, the dots in the formed image had a shape near the true circle, and a high quality image with no bleeding or color mixing due to dot coalescence is achieved.

In the first embodiment, therefore, a pH detecting unit is provided on the downstream side of the acidifying unit, so that the pH detecting unit can read the pH-related information from the surface of the processing object. The pH of the surface of the processing object is then controlled to a predetermined range (e.g., a range suitable for the type of ink, such as a range equal to or lower than 5, or a range equal to or more than 5.3 and equal to or lower than 6.0) by feedback- or feedforward-controlling the plasma-treating unit based on the read pH-related information.

A processing object modifying apparatus, a printing apparatus, a printing system, and a method for manufacturing a printout according to the first embodiment will now be explained in detail with reference to some of the drawings. Explained in the first embodiment is an image forming apparatus having four ejection heads (recording heads, ink heads) for four colors of black (K), cyan (C), magenta (M) and yellow (Y), but the ejection head is not limited thereto. Specifically, the image forming apparatus may also have ejection heads corresponding to colors green (G), red (R), and the others, or may have an ejection head only for the black (K) color. In the explanation hereunder, K, C, M, and Y correspond to black, cyan, magenta, and yellow, respectively.

Furthermore, in the description of the first embodiment, continuous paper wound into a roll (hereinafter, referred to as roll paper) is used as an example of the processing object 20. The processing object however is not limited thereto, and may be any recording medium on which an image can be formed, including cut paper, for example. If the recording medium is paper, any type of paper such as standard paper, high-quality paper, recycled paper, thin paper, thick paper, and coat paper may be used. Furthermore, the image forming apparatus may use anything with a surface on which an image can be formed with ink as the processing object, including an overhead projector (OHP) sheet, a synthetic resin film, and a metal thin film. The roll paper may be continuous paper with perforations at a given interval allowing the paper sheet to be torn apart (continuous stationary). In such a case, a page in the roll paper corresponds to an area extending between a pair of perforations at a given interval, for example.

Figure 13:
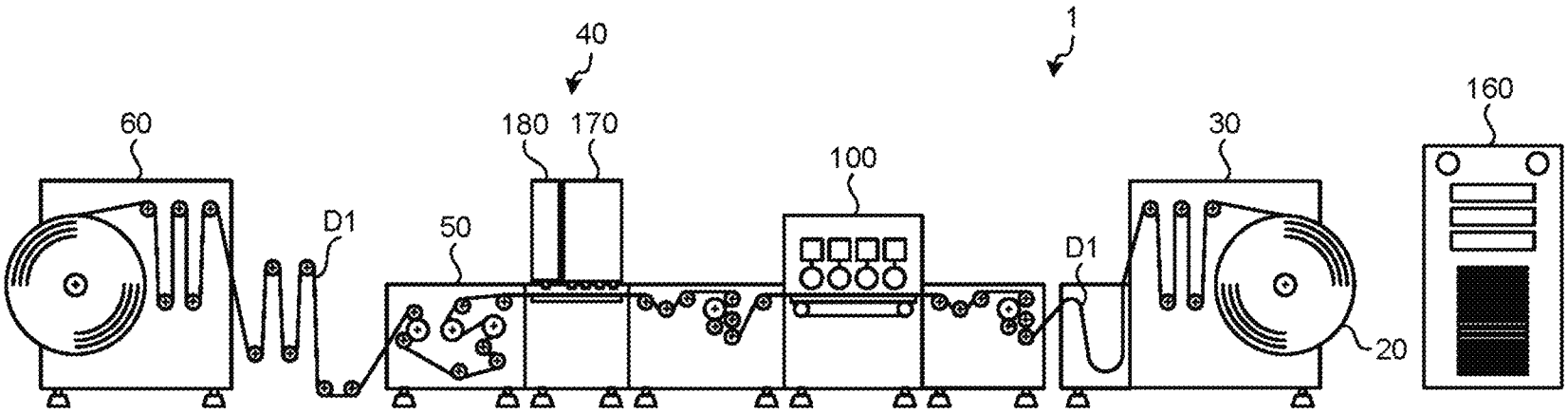
FIG. 13 is a schematic illustrating a general structure of a printing apparatus (system) according to the first embodiment.

FIG. 13 is a schematic illustrating a general structure of a printing apparatus (system) according to the first embodiment. As illustrated in FIG. 13, this printing apparatus (system) 1 includes a feeding unit 30 that feeds (conveys) the processing object 20 (roll paper) along a conveying path D1, a plasma processing apparatus 100 that plasma-processes the fed processing object 20 as a pre-process, and an image forming apparatus 40 that forms an image on the surface of the plasma-processed object 20. The image forming apparatus 40 may include an inkjet head 170 that forms an image to the plasma-processed object 20 via inkjet processing, and a colorimeter 180 that measures the pH-indication color (e.g., hue) of a pH indicator provided to the processing object 20. The image forming apparatus 40 may also include a post-processing unit that applies a post-process to the processing object 20 having an image formed. The printing apparatus (system) 1 may also include a dryer unit 50 for drying the post-processed processing object 20, and an ejection unit 60 for ejecting the processing object 20 having an image formed (and having been post-processed, in some cases). The printing apparatus (system) 1 may also include a controlling unit 160 that generates raster data from the image data to be printed, and that controls each unit included in the printing apparatus (system) 1. This controlling unit 160 is capable of communicating with the printing apparatus (system) 1 over a wired or wireless network. The controlling unit 160 may not be provided as one computer, and may be a plurality of computers connected over a network such as a local area network (LAN). The controlling unit 160 may also include a plurality of controlling units provided for the respective units of the printing apparatus (system) 1.

Figure 14:
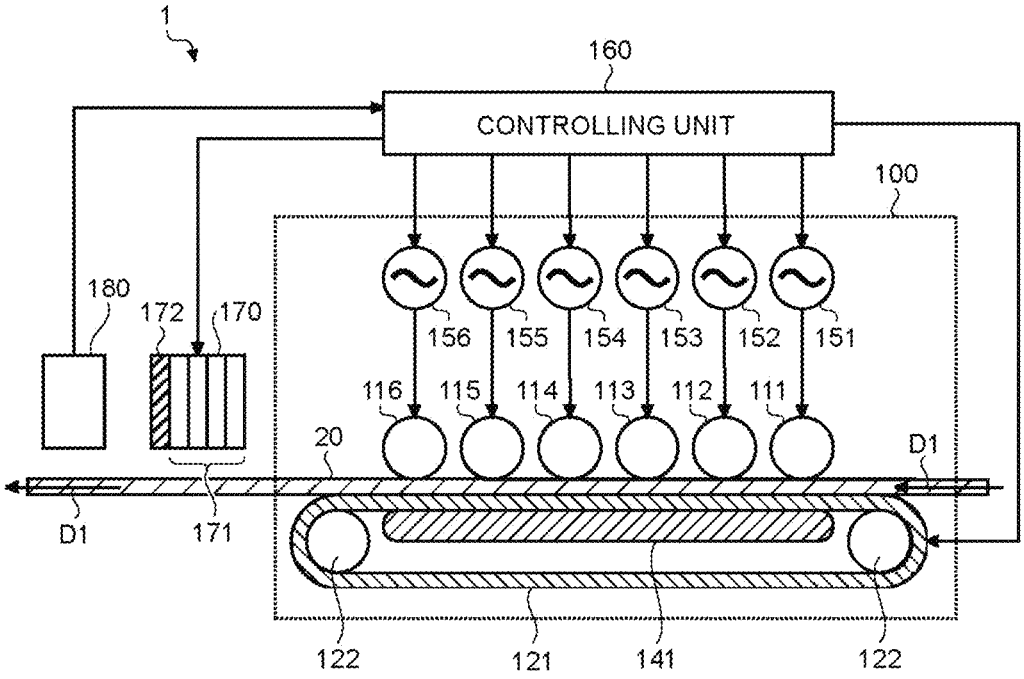
FIG. 14 is a schematic of exemplary structures around a plasma processing apparatus serving as an acidifying unit and an inkjet recording apparatus in the printing apparatus (system) according to the first embodiment.

A printing apparatus (system) 1 according to the first embodiment will now be explained in detail. FIG. 14 is a schematic of exemplary structures around the plasma processing apparatus serving as an acidifying unit and the inkjet recording apparatus in the printing apparatus (system) according to the first embodiment. Because the other structures are the same as those in the printing apparatus 1 illustrated in FIG. 13, detailed explanations thereof are omitted herein.

As illustrated in FIG. 14, in the printing apparatus (system) 1, one head of a plurality of heads provided to the inkjet head 170 is used as a head for ejecting the pH indicator. Specifically, the inkjet head 170 includes nozzles 171 for ejecting ink and a nozzle 172 for ejecting the pH indicator. The colorimeter 180 for measuring the pH indication color of the pH indicator attached on the processing object 20 is provided downstream of the inkjet head 170.

The plasma processing apparatus 100 includes a plurality of discharge electrodes 111 to 116 arranged along the conveying path D1, high-frequency high-voltage power sources 151 to 156 that supply high-frequency high-voltage pulse voltages to the respective discharge electrodes 111 to 116, a ground electrode 141 provided commonly for the discharge electrodes 111 to 116, a belt-conveyor-type endless dielectric 121 provided in a manner moving along the conveying path D1 between the discharge electrodes 111 to 116 and a counter electrode 141, and rollers 122. The processing object 20 is plasma-processed while being conveyed along the conveying path D1. When the discharge electrodes 111 to 116 arranged along the conveying path D1 are used, it is preferable to use an endless belt as the dielectric 121, as illustrated in FIG. 14, but a dielectric roller made from a metal roller coated with a dielectric may also be used. Providing the plasma processing apparatus 100 with the discharge electrodes 111 to 116 is also effective from the viewpoint of uniformly acidifying the surface of the processing object 20. Specifically, when the conveying speed (or printing speed) is the same, for example, the time for which the processing object 20 is passed through the plasma-filled space can be extended by treating the processing object 20 with a plurality of discharge electrodes, rather than by treating with one discharge electrode. As a result, the acidification processing can be provided to the surface of the processing object 20 more evenly.

The controlling unit 160 drives the rollers 122 based on an instruction from a higher-level apparatus not illustrated, causing the dielectric 121 to circulate thereby. Once the processing object 20 is fed onto the dielectric 121 from the feeding unit 30 positioned on the upstream side (see FIG. 13), the processing object 20 is passed along the conveying path D1 by the circulating dielectric 121. The high-frequency high-voltage power sources 151 to 156 then supply high-frequency high-voltage pulse voltages to the respective discharge electrodes 111 to 116 based on an instruction from the controlling unit 160. Another alternative for achieving the plasma energy amount required for acidifying the surface of the processing object 20 is extension of the time of the plasma processing. This may be achieved by decreasing the speed at which the processing object 20 is conveyed, for example.

The nozzles 171 for ejecting the ink in the inkjet head 170 may be provided with a plurality of heads of the same color (four colors by four heads). This configuration allows the inkjet recording process to be sped up. To achieve a resolution of 1200 dpi at a high speed, for example, the heads in the respective colors in the inkjet head 170 may be fixed in a manner offset from one another to correct the pitch between the nozzles ejecting ink. Furthermore, the heads of the respective colors may be input with a driving pulse with varying driving frequencies that correspond to the three different capacities of ink dots ejected from the nozzles, e.g., large, medium, or small droplets, for example.

The nozzle 172 for discharging the pH indicator in the inkjet head 170 ejects pH indicator indicating a pH-indication color corresponding to a pH. In this manner, the pH indicator can be applied to the white surface of the processing object 20. In this example, because the target pH range of the surface of the processing object 20 is equal to or more than 5.3 and equal to or lower than 6.0 (more preferably 5.8), it is preferable to use a solution of BCP that is sensitive to a pH range from 6.8 (purple) to 5.2 (yellow) (hereinafter, referred to as pH indicator range) as the pH indicator. Because the optimum pH differs depending on the type of the ink, pH indicator with another pH indicator range may be also used, without limitation to the BCP solution.

The nozzle 172 for ejecting the pH indicator that is a means for applying pH indicator may be provided separately from the inkjet head 170, that is, separately from the nozzles 171 for ejecting the ink. In such a configuration, the nozzle 172 for ejecting the pH indicator may be controlled by a controlling unit (not illustrated) provided separately for the pH indicator, or may be controlled by the same controlling unit 160 as that for controlling the nozzles 171 for ejecting the ink. When the pH indicator has a property to become alternated by the heat, it is preferable to use a piezoelectric inkjet head for the inkjet head 170 for ejecting the pH indicator. When the pH indicator does not have such a property to become alternated by the heat, a thermal inkjet head may be used. In this manner, the means for applying the pH indicator may be changed variously depending on the properties of the pH indicator.

If the means for applying pH indicator is positioned upstream of the plasma processing apparatus 100 while an aqueous solution is used as the pH indicator, a high voltage may be applied to the processing object 20 due to the electric permittivity of the water. It is therefore preferable to position the nozzle 172 for ejecting the pH indicator on the downstream side of the plasma processing apparatus 100.

The colorimeter 180 positioned downstream of the inkjet head 170 measures the pH-indication color of the pH indicator applied on the surface of the processing object 20, in a non-contact manner. The hue measured by the colorimeter 180 is input to the controlling unit 160.

By adjusting the conveying speed of the processing object 20 in the plasma processing apparatus 100 on the basis of the pH-indication color (e.g., hue) measured by the colorimeter 180, the controlling unit 160 adjusts the plasma energy amount delivered to the processing object 20 so that the pH of the surface of the processing object 20 is controlled to a target range (a range suitable for the type of ink, such as a range equal to or lower than 5, or a range equal to or more than 5.3 and equal to or lower than 6.0).

Figure 15:
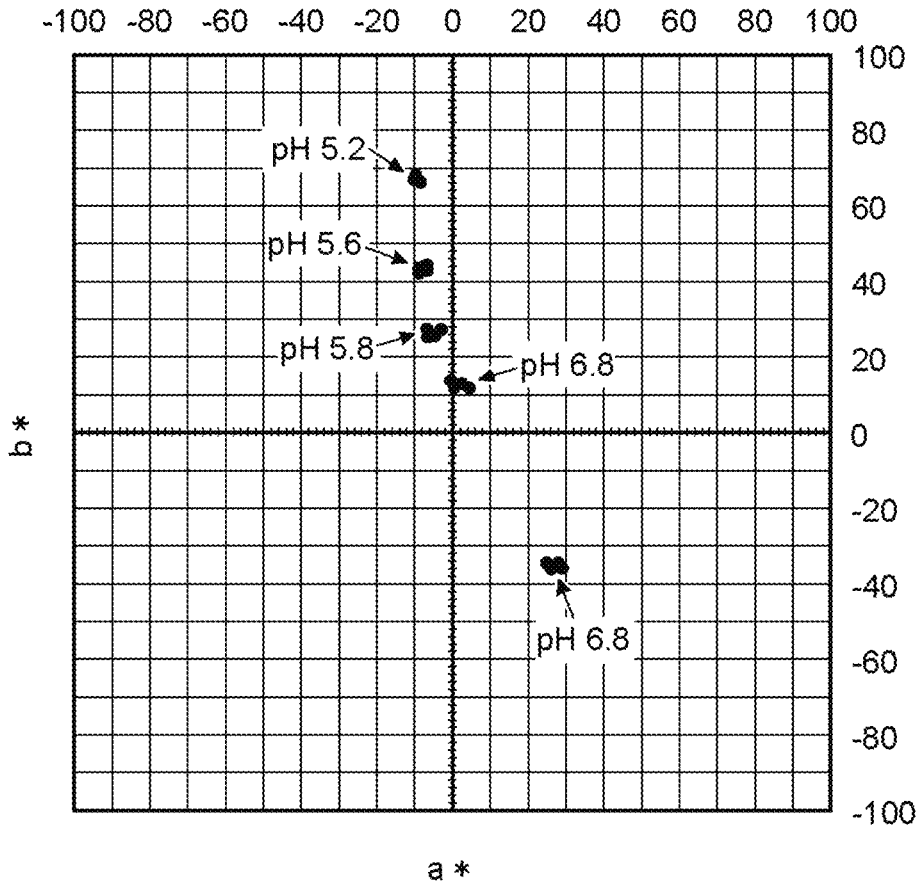
FIG. 15 is a graph indicating exemplary measurement results measured by a colorimeter and plotted to an a*b* plane when a bromocresol purple (BCP) solution is used as a pH indicator in the first embodiment.
Figure 16:
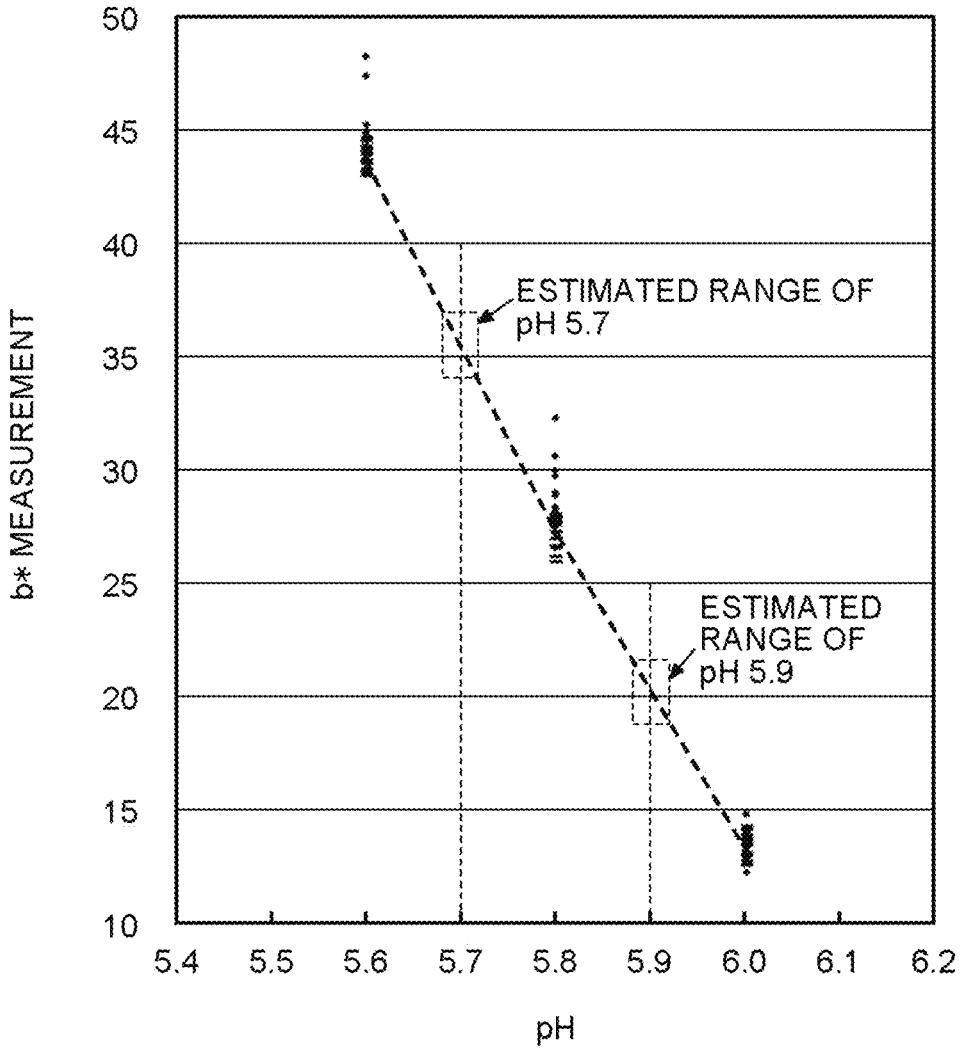
FIG. 16 is a graph illustrating a relation between the b* measurement and the pH, plotted based on the measurement results of the colorimeter illustrated in FIG. 15.

When used as the pH indicator is BCP, as mentioned earlier, the change in the pH-indication color from purple to yellow has a distribution extending in the direction of the vertical axis b* in the a*b* plane in CIE 1976 (L*, a*, b*) color space, for example. FIG. 15 is a graph indicating exemplary measurement results measured by the colorimeter and plotted to the a*b* plane when the BCP solution is used as the pH indicator in the first embodiment. FIG. 16 is a graph illustrating a relation between the b* measurement and the pH, plotted based on the measurement results of the colorimeter illustrated in FIG. 15. As may be clear from FIGS. 15 and 16, the pH of the surface of the processing object 20 can be identified by analyzing b*, among the pH indication colors measured by the colorimeter 180.

The units (apparatuses) illustrated in FIG. 13 or 14 may be housed in respective separate housings to provide the printing system 1 as a whole, or may be housed in the same housing to provide the printing apparatus 1. When the units are provided as the printing system 1, the pH detecting apparatus including the nozzle 172 for ejecting the pH indicator and the colorimeter 180 may be provided inside of the printing system 1. Furthermore, when the units are provided as the printing system 1, the controlling unit 160 may be included in any one of the units or the apparatuses.

Figure 17:
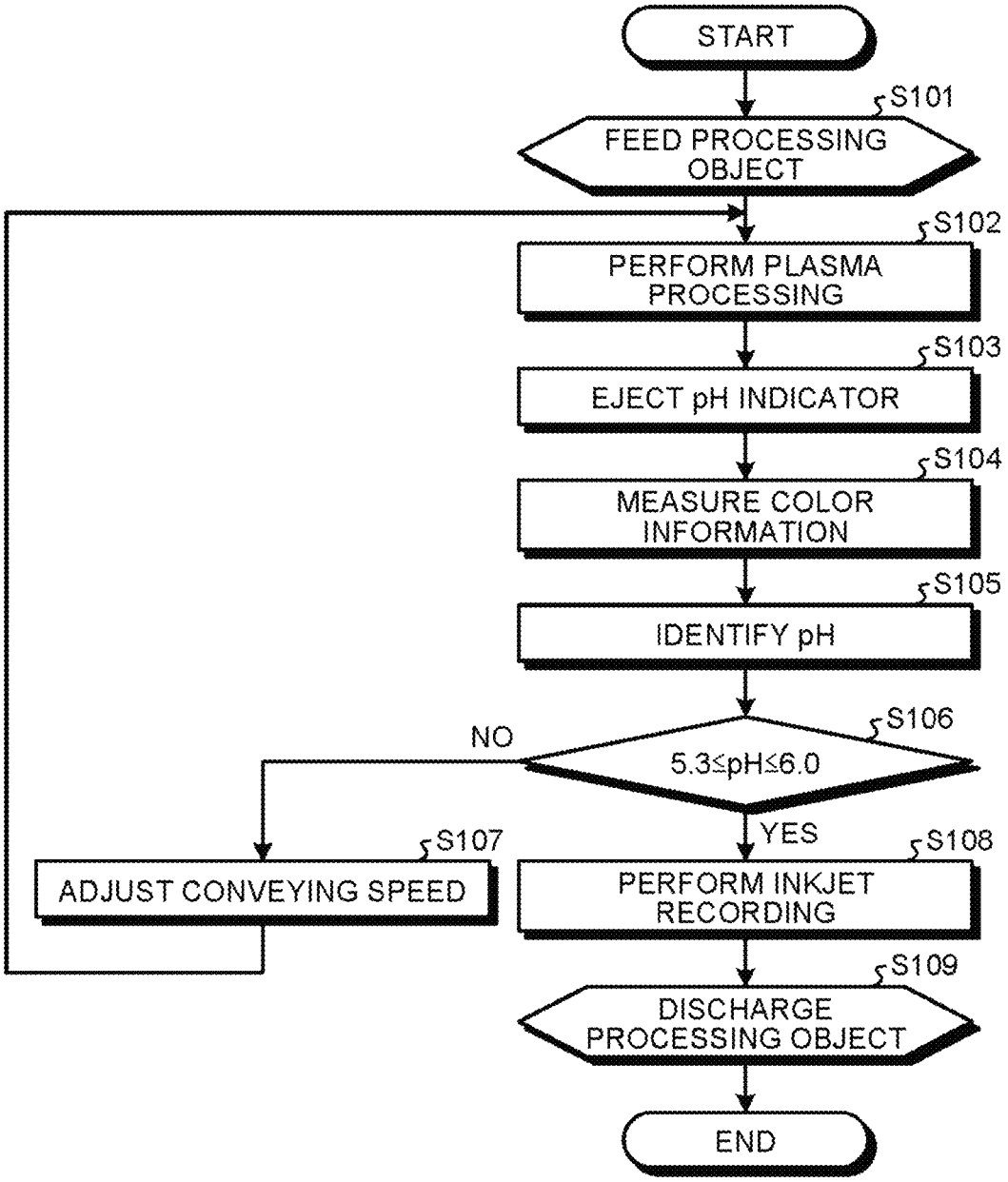
FIG. 17 is a flowchart illustrating an exemplary printing process including an acidification processing according to the first embodiment.

A printing process including the plasma processing according to the first embodiment will now be explained in detail with reference to some of the drawings. FIG. 17 is a flowchart illustrating an exemplary printing process including the acidification processing according to the first embodiment. Illustrated in FIG. 17 is an example in which the printing apparatus 1 illustrated in FIG. 14 is used to execute printing on a piece of cut paper (a recording medium cut in a given size) as the processing object 20. The processing object 20, however, is not limited to cut paper, and the same printing process may be applied to roll paper wound in a roll.

As illustrated in FIG. 17, in the printing process, to begin with, the controlling unit 160 feeds the processing object 20 on the dielectric 121 arriving from the upstream into the plasma processing apparatus 100, by driving the rollers 122 and causing the dielectric 121 to circulate (Step S101). The controlling unit 160 then plasma-treats the processing object 20 by driving the high-frequency high-voltage power sources 151 to 156 and supplying pulse voltages to the respective discharge electrodes 111 to 116 (Step S102). If no detection result has been received from the colorimeter 180 prior to the plasma processing, the controlling unit 160 supplies the plasma energy at a predetermined intensity to the discharge electrodes 111 to 116. If some detection result has been received from the colorimeter 180, the controlling unit 160 adjusts the number of high-frequency high-voltage power sources 151 to 156 to be driven and the plasma energy supplied to the discharge electrodes 111 to 116 based on the detected pH. At that time, the controlling unit 160 may adjust the conveying speed of the processing object 20 by controlling the rotation speed of the rollers 122.

The nozzle 172 for ejecting the pH indicator in the inkjet head 170 then is caused to eject the pH indicator, and to apply the pH indicator to the plasma-processed area of the processing object 20 (Step S103). The controlling unit 160 then acquires the color information (e.g., pH indication color) of the pH indicator from the colorimeter 180 (Step S104), and identifies the pH of the surface of the processing object 20 applied with the plasma processing by analyzing the color information (Step S105).

The controlling unit 160 then determines whether the identified pH is within a predetermined range (a range suitable for the type of ink, such as a range equal to or lower than 5, or a range equal to or more than 5.3 and equal to or lower than 6.0) (Step S106). If the pH is not within the predetermined range (NO at Step S106), the controlling unit 160 adjusts the conveying speed of the processing object 20 by controlling the rotation speed of the rollers 122 (Step S107), and shifts the process back to Step S102. For example, if the pH is higher than the predetermined range, the controlling unit 160 slows down the rotation speed of the rollers 122 to reduce the conveying speed of the processing object 20, thereby extending the time by which the processing object 20 is plasma-processed. If the pH is lower than the predetermined range, the controlling unit 160 speeds up the rotation speed of the rollers 122 to increase the conveying speed of the processing object 20, thereby reducing the time by which the processing object 20 is plasma-processed. In this manner, the plasma energy amount delivered to the processing object 20 is increased or decreased using the time of the plasma processing, so that the pH of the surface of the processing object 20 applied with the processing is adjusted to the predetermined range.

On the other hand, if the pH is within the predetermined range (YES at Step S106), the controlling unit 160 executes the inkjet recording process to the plasma-processed object 20 by driving the nozzles 171 for ejecting the ink in the inkjet head 170 (Step S108), discharges the processing object 20 to the downstream side of the inkjet head 170 (Step S109), and ends the process.

If the pH is higher than the predetermined range at Step S106, the processing object 20 may be bypassed via a bypass path not illustrated, and the plasma processing may be applied to the same processing object 20 (Step S102). This configuration allows no processed object 20 to be wasted. Furthermore, even if recording media with different properties are mixed as the processing object 20, the recording media can be handled in the same process.

When roll paper is used as the processing object 20, the pH of the processing object 20 applied with the plasma processing may be measured using the leading end of the paper guided by a paper feeding apparatus, not illustrated, at Steps S103 to S106. When roll paper is used, because the properties remain almost the same in the entire roll, continuous printing can be performed with the same settings, once the plasma energy amount is adjusted using the leading end. The properties of the paper, however, may change when the operation is stopped for a long time without using up the roll paper, so that the pH after the plasma processing may be measured again in the same manner, using the leading end, before the printing is restarted.

In such a case, the process at Steps S103 to S107 for applying the pH indicator and adjusting the plasma energy amount may be executed regularly or continuously. Once the plasma processing is performed, the pH may be measured using a margin of the roll paper. In this manner, the control can be adjusted more specifically and performed stably.

As described above, according to the first embodiment, by adjusting the plasma energy amount by controlling the conveying speed of the processing object 20, a high-quality printout can be achieved. Furthermore, because the acidification processing can be performed stably even when the processing object 20 has different properties or when different printing speeds are used, good-quality image recording can be achieved stably.

Explained in the embodiment described above is an example in which a BCP solution is used as the pH indicator, but it is not limited thereto. Specifically, any pH indicator suitable for a required pH indication may be used. Examples of the other pH indicators than the BCP solution include a litmus solution and a bromothymol blue (BTB) solution.

Furthermore, depending on the type of the pH indicator used, a* or L*, for example, in the CIE 1976 (L*, a*, b*) color space may be analyzed. Furthermore, the indication color is not limited to the "1976 CIE L*a*b* space", and an RGB system, an XYZ system, a Luv system, or the like may also be used. For example, when the required pH matches the range of litmus change, litmus may be used as the pH indicator, and the X-axis value in the XYZ color space may be detected. Furthermore, a means for detecting the color information from the pH indicator is not limited to the colorimeter 180. Specifically, as long as some kind of color information for identifying a pH can be acquired, various modifications are still possible.

Second Embodiment

A processing object modifying apparatus, a printing apparatus, a printing system, and a method for manufacturing a printout according to a second embodiment will now be explained with reference to some of the drawings. In the explanation hereunder, redundant explanations of the elements that are the same as those described above are omitted.

In the first embodiment, the effect of the plasma processing (e.g., pH) on the surface of the processing object 20 is controlled by controlling the conveying speed of the processing object 20 and adjusting the plasma energy amount delivered to the processing object 20. In addition to the controlling of the conveying speed, there are also other ways for adjusting the plasma energy amount delivered to the processing object 20, such as adjustment of the frequency or the voltage of the pulse voltage to be applied to the discharge electrodes (corresponding to the plasma energy amount) and adjustment of the number of driven discharge electrodes.

If the conveying speed is reduced to achieve the required plasma processing effect, the printing speed may also be reduced. To perform the image recording to the processing object 20 at a high speed, the time of the plasma processing needs to be reduced. To reduce the time of the plasma processing, a plurality of discharge electrodes 111 to 116 may be used, as mentioned earlier, and a required number of the discharge electrodes 111 to 116 may be driven on the basis of the printing speed and the required pH, or the plasma energy amount applied to each of the discharge electrodes 111 to 116 may be adjusted. The acidification processing may also be adjusted by providing a humidity adjusting mechanism to the plasma processing apparatus 100 (see Japanese Patent Application Laid-open No. 2013-199017). Any combinations of the above are also still possible.

In the second embodiment, an example of a combination of the adjustment of the processing object conveying speed and the switching of the number of driven electrode will be explained in detail with reference to some of the drawings.

A printing apparatus (system) according to the second embodiment may have the same configuration as the printing apparatus (system) 1 explained as an example in the first embodiment. The printing apparatus (system) according to the second embodiment, however, operates in the manner described below.

Figure 18:
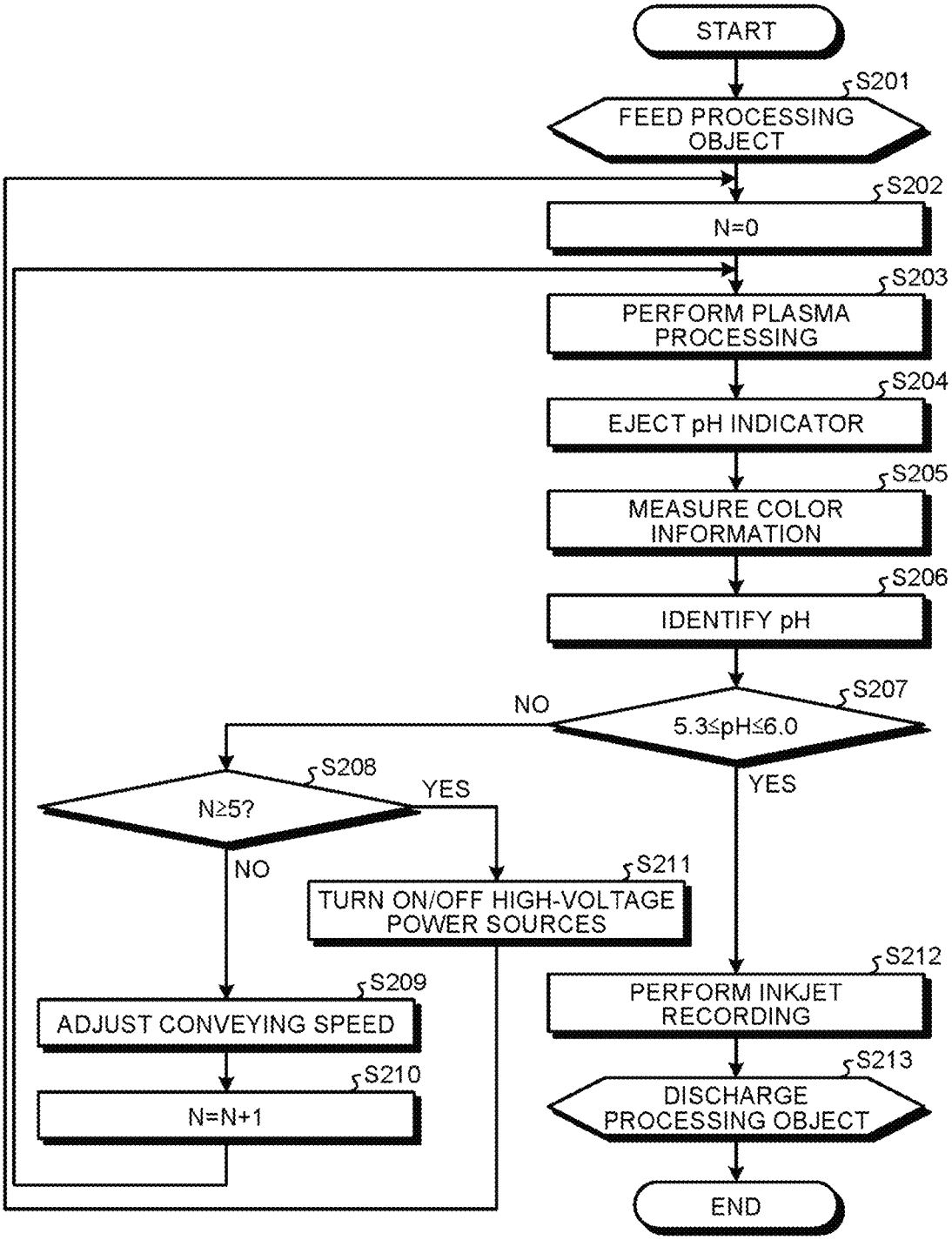
FIG. 18 is a flowchart illustrating an exemplary printing process including an acidification processing according to a second embodiment.

FIG. 18 is a flowchart illustrating an exemplary printing process including the acidification processing according to the second embodiment. In the example illustrated in FIG. 18, the printing apparatus 1 illustrated in FIG. 14 is used to execute printing on a piece of cut paper (recording media cut in a given size) as the processing object 20, in the same manner as the example illustrated in FIG. 17. The processing object 20 is not limited to cut paper, and the same printing process may be applied to roll paper wound in a roll.

As illustrated in FIG. 18, in the printing process, to begin with, the controlling unit 160 conveys the processing object 20 on the dielectric 121 arriving from the upstream side into the plasma processing apparatus 100, by driving the rollers 122 to circulate the dielectric 121, in the same manner as at Step S101 illustrated in FIG. 17 (Step S201). The controlling unit 160 then resets a counter not illustrated (count N=0) (Step S202).

The controlling unit 160 then determines whether the pH of the surface of the processing object 20 applied with the plasma is within a predetermined range (a range suitable for the type of ink, such as a range equal to or lower than 5, or a range equal to or more than 5.3 and equal to or lower than 6.0) by performing the same operations as those at Steps S102 to S106 in FIG. 17 (Steps S203 to S207).

If the pH is not within the predetermined range (NO at Step S207), the controlling unit 160 determines whether the count N of the counter has reached a predetermined count (e.g., 5) (Step S208). If the count N has not reached the predetermined count (NO at Step S208), the controlling unit 160 adjusts the conveying speed of the processing object 20 by controlling the rotation speed of the rollers 122, in the same manner as at Step S107 in FIG. 17 (Step S209). The controlling unit 160 then increments the count of the counter not illustrated by one (Step S210), and shifts the process back to Step S203.

If the count of the counter has reached the predetermined count (YES at Step S208), the controlling unit 160 adjusts the number of driven high-frequency high-voltage power sources 151 to 156 (Step S211). For example, if the pH is higher than the predetermined range, the controlling unit 160 drives (turns ON) one or more of the high-frequency high-voltage power sources 151 to 156 that are not being driven, that is, one or more of the high-frequency high-voltage power sources 151 to 156 not supplying a pulse voltage to the corresponding discharge electrode, to increase the plasma energy amount. If the pH is lower than the predetermined range, the controlling unit 160 stops (turns OFF) one of the high-frequency high-voltage power sources 151 to 156 that are being driven. The pH after changing the number of driven high-frequency high-voltage power sources 151 to 156 does not necessarily need to be within the predetermined range (a range suitable for the type of ink, such as a range equal to or lower than 5, or a range equal to or more than 5.3 and equal to or lower than 6.0).

As a result of the determination at Step S207, if the pH is within the predetermined range (YES at Step S207), the controlling unit 160 executes the inkjet recording process to the plasma-processed object 20 by driving the nozzles 171 for ejecting the ink in the inkjet head 170 (Step S212), discharges the processing object 20 to the downstream side of the inkjet head 170 (Step S213), and ends the process.

With the operation described above, according to the second embodiment, because the plasma energy amount in the acidifying unit is precisely adjusted, a high-quality printout can be achieved, in the same manner as in the first embodiment. Furthermore, because the acidification processing can be performed stably even when the properties of the processing object or the printing speed are/is changed, good-quality image recording can be achieved stably. Furthermore, according to the second embodiment, because the adjustment of the conveying speed is combined with the adjustment of the number of discharging electrodes, the required plasma processing effect can be achieved, while preventing a reduction in the printing speed.

As illustrated in FIG. 12, the effect of the plasma processing differs depending on the types of media. To resolve the difference, the processing speed may be slowed down, or the number of electrodes used in the processing may be increased so that the plasma processing is performed effectively, as described earlier. In the future, however, there might be media on which the effect is not well achieved even when these countermeasures are taken. To address the difference in such a case, ejection performed in the inkjet recording may be modified, as well as repeating the plasma processing.

For example, if the effect of the plasma processing cannot be achieved very much, it is preferable to form a dot corresponding to a large droplet by causing a plurality of nozzles to eject small ink droplets instead of a large ink droplet. For example, a large droplet achieving a resolution of 600 dpi has a size approximately six times larger than the small droplet. A simplest example of a method for forming a dot corresponding to a large droplet is causing downstream nozzles to eject ink, taking the conveying speed into consideration, so that the ink is ejected and lands on the same position.

Other possible alternatives include ejecting small droplets in such a manner that the droplets land around a first small droplet ejected at the center, and, oppositely, ejecting the last small droplet at the center. If a droplet size six times larger than the small droplet is suitable as a large droplet, five small droplets may be ejected and allowed to land around one small droplet at the center, in a shape of pentagon. Another possible control is not to eject the small droplet at the center, taking bleeding of the ink into consideration.

By ejecting a plurality of small droplets, the ink is allowed to wet, spread on, and permeate into, for example, a medium on which the effect of the plasma processing cannot be achieved very well, with some time lag. It is more effective if a plurality of small droplets corresponding to a large droplet are ejected after the plasma processing is repeated at a slower speed.

Figure 19:
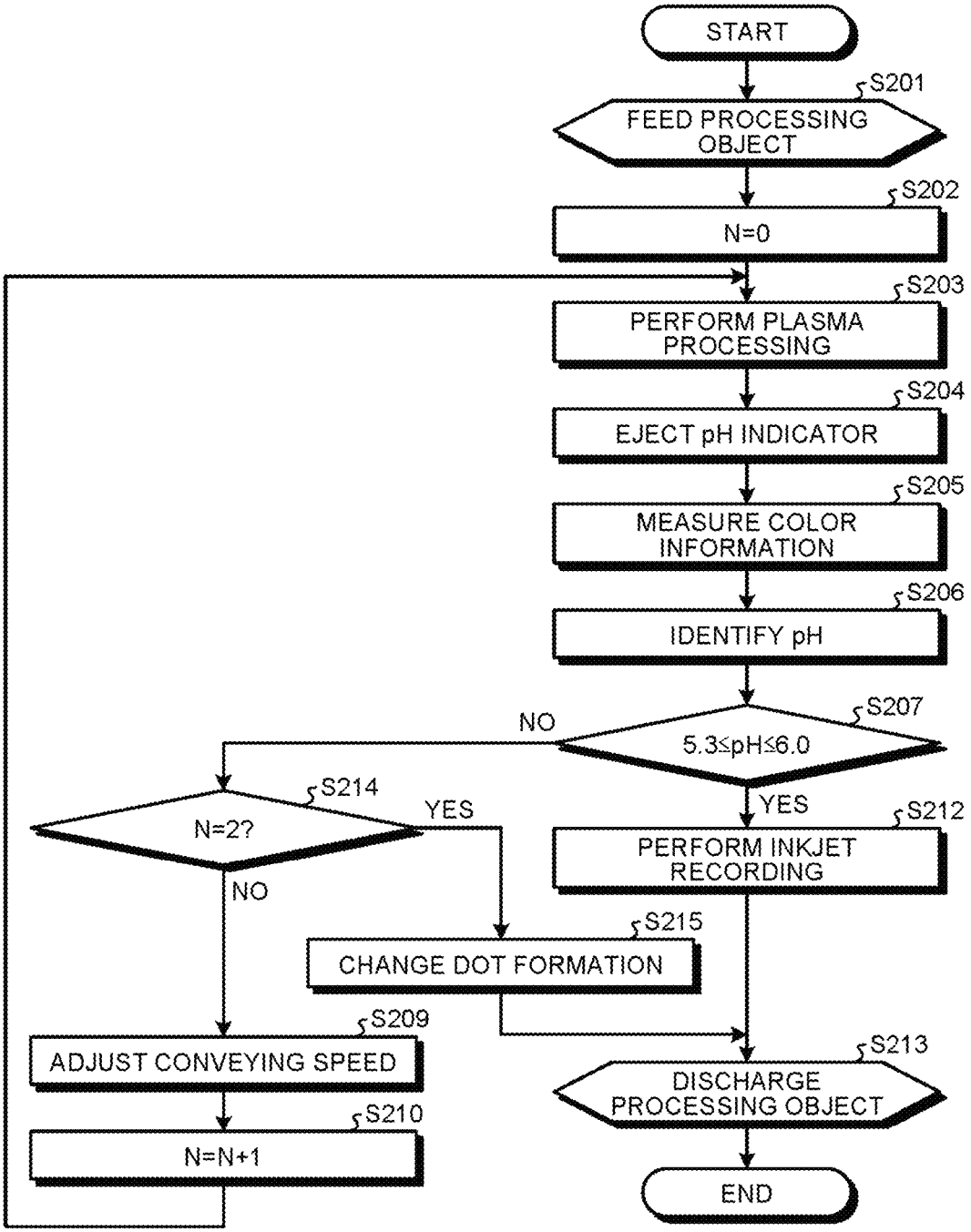
FIG. 19 is a flowchart illustrating another exemplary printing process including the acidification processing according to the second embodiment.

FIG. 19 is a flowchart illustrating another exemplary printing process including the acidification processing according to the second embodiment. The flowchart according to this example is different from the flowchart illustrated in FIG. 18 in not having Step S211 in FIG. 18, and having additional Steps S214 and S215. Other Steps are the same as those in the flowchart illustrated in FIG. 18. In this flowchart according to this example, Step S209 described above is executed if the count N is not a predetermined count (for example, 2) (NO at Step S214). If the count N is the predetermined count (YES at Step S214), the formation of dots is switched from a regular approach to another approach, e.g., to an approach using a large droplet and a small droplet described above (Step S215).

In the embodiment described above, the pH indicator is attached to the processing object 20 applied with the plasma processing, but it is not limited to such a configuration. For example, the plasma processing may be performed after the pH indicator is applied to the processing object 20, provided that the processing object 20 applied with the pH indicator is sufficiently dried. Furthermore, in a configuration in which an apparatus for drying the pH indicator attached on the processing object 20 is provided along the conveying path, the plasma processing apparatus may be positioned downstream of the dryer apparatus.

Furthermore, in the embodiment described above, the target range of the pH is set to 5.3 to 6.0 using the BCP solution as the pH indicator, but it is not limited thereto. For example, considering the target pH from the view of a dot diameter, circularity, or beading suppression, a pH of 5.8 may be used as the target, and the processing may be controlled so that the pH is adjusted closer to the target pH as much as possible.

Furthermore, while a head (nozzle) in the inkjet head 170 is used as a means for applying the pH indicator to the processing object 20, it is not limited thereto. For example, an apparatus for applying a solvent such as undercoat to the processing object 20 may be used. Various other exemplary means for applying the pH indicator may be used, such as a roller, a brush, a sponge (preferably a melamine sponge, for example), a urethane plate, a bar coater (including a wire bar coater), and a felt-tip pen.

Use of an inkjet head as a means for applying pH indicator is preferable because the pH indicator can be attached to the processing object 20 in the conditions nearer to those in which the ink is attached. Specifically, use of an inkjet head is effective from the view of detecting (or estimating) how the ink is attached. At that time, by using a relatively high resolution, e.g., 600 dpi to 1200 dpi, for the pH indicator, the surface of the processing object 20 can be covered with the pH indicator seamlessly, so that the pH of the surface of the processing object 20 can be detected more precisely.

Furthermore, while the colorimeter 180 is used as a means for acquiring (detecting) color information from the pH indicator, any other modifications are possible, as long as such a means is capable of acquiring (detecting) the color information from the pH indicator. Examples of such a means include a charge-coupled device (CCD) and other image capturing units. In the embodiments described above, the color information is extracted from the pH indicator ejected on the processing object 20, but the pH may be detected using the above-mentioned pH meter or the like, without ejecting the pH indicator. Furthermore, the conveyor may be stopped when the pH is detected. Furthermore, in the embodiments described above, the conveying speed of the processing object 20 in the plasma processing is changed using the pH, but the conveying speed may be changed based on the degree of ink agglomeration, circularity, or a difference in the density of the ink, or the like.

Furthermore, used as an example in the embodiments described above is one-pass inkjet recording that uses the nozzles arranged in a manner covering an area wider than the width of the processing object 20 (the length of a direction perpendicular to the conveying direction), but it is not limited thereto. For example, what is called shuttle inkjet recording, in which a moving body referred to as a carriage on which the inkjet head is mounted is carried back and forth in the width direction of the processing object (main scanning direction), may be used. This configuration has an advantage that the time for drying ink can be more easily ensured compared with the one-pass recording, because the carriage is carried back and forth. Furthermore, a longer time for drying ink can be ensured by performing the plasma processing and the image formation only in one way (e.g., forward carriage), rather than in both of the forward carriage and the backward carriage. When the plasma processing and the image formation are performed only in one way rather than in both of the forward carriage and the backward carriage, image defectiveness resulting from any mismatch in the timing of the printing or the positioning in the reverse direction (e.g., backward carriage) can be reduced, advantageously.

Furthermore, in the embodiments described above, the pH of the surface of the processing object 20 is used in the evaluation of the effect of the plasma processing, but it is not limited thereto. For example, a liquid having a specified surface tension (e.g., water) may be dropped on the surface of the processing object 20 applied with the plasma processing, and the condition of the droplet (degree by which the droplet is repelled, for example, the height or the contact angle of the droplet) may be measured to evaluate the effect of the plasma processing. Alternatively, the image density after the printing may be measured and controlled using a reflection densitometer.

According to the present embodiments, it is possible to provide a processing object modifying apparatus, a printing apparatus, a printing system, and a method for manufacturing a printout, which can modify the processing object to manufacture a high-quality printout.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A processing object modifying apparatus comprising:

a conveying unit that conveys a processing object;

a plasma processing unit that performs plasma processing onto a surface of the processing object while the processing object is being conveyed by the conveying unit;

an inkjet recording unit that ejects liquid to the processing object; and a controlling unit that controls the conveying unit to change a conveying speed of the processing object on the basis of a condition of the liquid dropped on the surface of the processing object applied with the plasma processing;

wherein the condition of the liquid dropped on the surface is a degree of ink agglomeration on the processing object applied with the plasma processing.

2. The processing object modifying apparatus according to claim 1, further comprising:

a measuring unit that measures a pH value of the processing object to which the plasma processing has been applied;

wherein the controlling unit changes a plasma energy amount in the plasma processing unit when a measurement result indicates that a number of times that the pH value has come off from a predetermined value or a predetermined range reaches a predetermined number of times.

3. The processing object modifying apparatus according to claim 1, wherein the inkjet recording unit controls an ejection amount of the liquid according to the conveying speed.

4. The processing object modifying apparatus according to claim 3, wherein the inkjet recording unit controls the ejection amount by ejecting a plurality of small droplets each of which has a size smaller than a large droplet of the liquid, instead of ejecting the large droplet.

5. The processing object modifying apparatus according to claim 1, wherein the condition of the liquid dropped on the surface is a circularity of the liquid on the processing object applied with the plasma processing.

6. The processing object modifying apparatus according to claim 1, wherein the condition of the liquid dropped on the surface is an amount of ink density difference on the processing object applied with the plasma processing.

7. A method for manufacturing a printout that is a processing object printed with an image using inkjet recording, the method comprising:

conveying the processing object;

performing plasma processing onto a surface of the processing object while the processing object is being conveyed;

ejecting liquid to the processing object; and changing a conveying speed of the processing object on the basis of a condition of the liquid dropped on the surface of the processing object applied with the plasma processing;

wherein the condition of the liquid dropped on the surface is a degree of ink agglomeration on the processing object applied with the plasma processing.

8. The method for manufacturing a printout according to claim 7, further comprising controlling an ejection amount of the liquid according to the conveying speed.

9. The method for manufacturing a printout according to claim 8, wherein the ejection amount is controlled by ejecting a plurality of small droplets each of which has a size smaller than a large droplet of the liquid, instead of ejecting the large droplet.

10. A printing system comprising:

a conveying unit that conveys a processing object;

a plasma processing unit that performs plasma processing onto a surface of the processing object while the processing object is being conveyed by the conveying unit; and an inkjet recording unit that controls the conveying unit to change a conveying speed of the processing object on the basis of a condition of a liquid dropped on the surface of the processing object applied with the plasma processing, wherein the condition of the liquid dropped on the surface is a degree of ink agglomeration on the processing object applied with the plasma processing.

11. The printing system according to claim 10, wherein the inkjet recording unit controls an ejection amount of the liquid according to the conveying speed.

12. The printing system according to claim 11, wherein the inkjet recording unit controls the ejection amount by ejecting a plurality of small droplets each of which has a size smaller than a large droplet of the liquid, instead of ejecting the large droplet.

* * * * *